US005197111A

United States Patent [19]

Mills, II et al.

[11] Patent Number: 5,197,111

[45] Date of Patent: Mar. 23, 1993

[54] CONVECTION HEATER WITH HEATING ELEMENTS ARRANGED IN A STAIR STEP CONFIGURATION

[75] Inventors: David S. Mills, II; Robert D. Rendel, both of Laurinburg; Carl P. Hinesley, Pinehurst, all of N.C.

[73] Assignee: The Marley Company, Mission Woods, Kans.

[21] Appl. No.: 746,694

[22] Filed: Aug. 19, 1991

[51] Int. Cl.[5] ..... F24H 3/00; F24H 9/02; F24D 13/00; F24D 19/06

[52] U.S. Cl. ..... 392/347; 165/53; 165/55; 165/129; 392/352; 392/370; 392/373

[58] Field of Search ..... 165/55, 129, 128, 53, 165/54; 392/347-377

[56] References Cited

U.S. PATENT DOCUMENTS 1,882,719 10/1932 Armstrong et al. ..... 165/55
2,848,199 8/1958 Drewes ..... 165/55 X

FOREIGN PATENT DOCUMENTS

A039314 10/1931 France ..... 392/352
875062 9/1942 France ..... 392/374
43409 1/1938 Netherlands ..... 165/129

*Primary Examiner*—Anthony Bartis
*Attorney, Agent, or Firm*—Kokjer, Kircher, Bowman & Johnson

[57] ABSTRACT

An electric convection space heater for placement adjacent to a wall includes a plurality of elongated electric heating elements positioned in an elongated housing having a front panel having an elongated cold air inlet, a back panel for placement adjacent to a wall and a top portion with a plurality of elongated heated air outlet slots. The heating elements are arranged to extend longitudinally in the housing below the outlet slots with the heating elements horizontally disposed in spaced apart stair-step configuration with each heating element being located at progressively lower elevations from the front panel to the rear panel. The outlet slots occupy a front to back dimension on the housing top portion which exceeds the distance between the front and back elements. The heated air rising above each element induces the heated air rising above the immediately rearward element to flow outwardly through the slots in a direction away from the wall thus counteracting the normal wall hugging effect of the heated air and preventing wall streaking and damage to wall coverings.

3 Claims, 2 Drawing Sheets

CONVECTION HEATER WITH HEATING ELEMENTS ARRANGED IN A STAIR STEP CONFIGURATION

FIELD OF THE INVENTION

This invention relates generally to the field of heating and deals more particularly with a convection heater in which the heating elements are uniquely arranged in a stair step fashion which provides a beneficial air flow pattern.

BACKGROUND OF THE INVENTION

Convection heaters have long been available and normally use either electrical heating elements or fluid based heating elements. Typically, the heater is placed adjacent to a wall either on the floor or mounted on the wall at an elevated location. When the heating elements are energized, the air within the heater housing is heated by them and naturally rises by convection. The air discharges from the heater housing through outlets in its top, and the discharging air induces ambient air to enter the housing through inlets which are located either in the lower part of the front panel or in the bottom panel in the case of a wall mounted unit.

Although convection heaters have functioned well for the most part, their proximity to the wall can create problems. The heating elements are arranged side by side in a row in conventional heaters, and the air that is discharged from them tends to hug the adjacent wall. When electric heating elements are energized, the sheath of the element can reach temperatures as high as 750° F., and the temperature of the air exiting the heater outlets can approach 400° F. Even though convective mixing with ambient air quickly reduces the temperature of the air, the wall in contact with the air can reach 150°-190° F. Temperatures this high can damage many types of wall coverings, especially vinyl wall coverings which have become increasingly popular in recent years. Dust and other airborne particles passing in close proximity to the sheath can be charred by the high heat of the element sheath and leave unsightly streaks and other marks on the wall immediately above the heating unit.

SUMMARY OF THE INVENTION

The present invention is directed to an improved convection heater in which the heating elements are uniquely arranged in a stair step configuration that induces the heated air to flow away from the adjacent wall, thereby reducing the problems of wall damage and unsightly wall streaking that have plagued conventional heaters.

In accordance with the invention, elongated heating elements are mounted transversely in the housing of a convection heater and are spaced apart from front to back. The front element is elevated relative to the middle element which is in turn elevated relative to the back element. Accordingly, the elements are progressively lower from front to back rather than all being at the same elevation as in the conventional practice.

This stair step arrangement of the heating elements has the advantage of creating a flow of heated air that is farther away from the adjacent wall than is the case with conventional heaters. The heated air which rises from each heating element induces the air below to follow it. Because each element is at a higher position than the element immediately to the rear, the forward elements induce heated air from the rearward elements to flow forwardly or away from the wall. Thus the heated air from the center element is induced to flow forwardly and follow the heated air rising from the front element. Similarly, the air heated by the back element is induced in a forward direction by the air rising from the center and front elements. The overall result is that the tendency for the hot air to hug the wall is effectively counteracted by the convection currents which cause the hot air to flow away from the wall as it rises. The air which is closest to the wall is relatively cool because it is heated principally by the rear element which is at a relatively low position.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
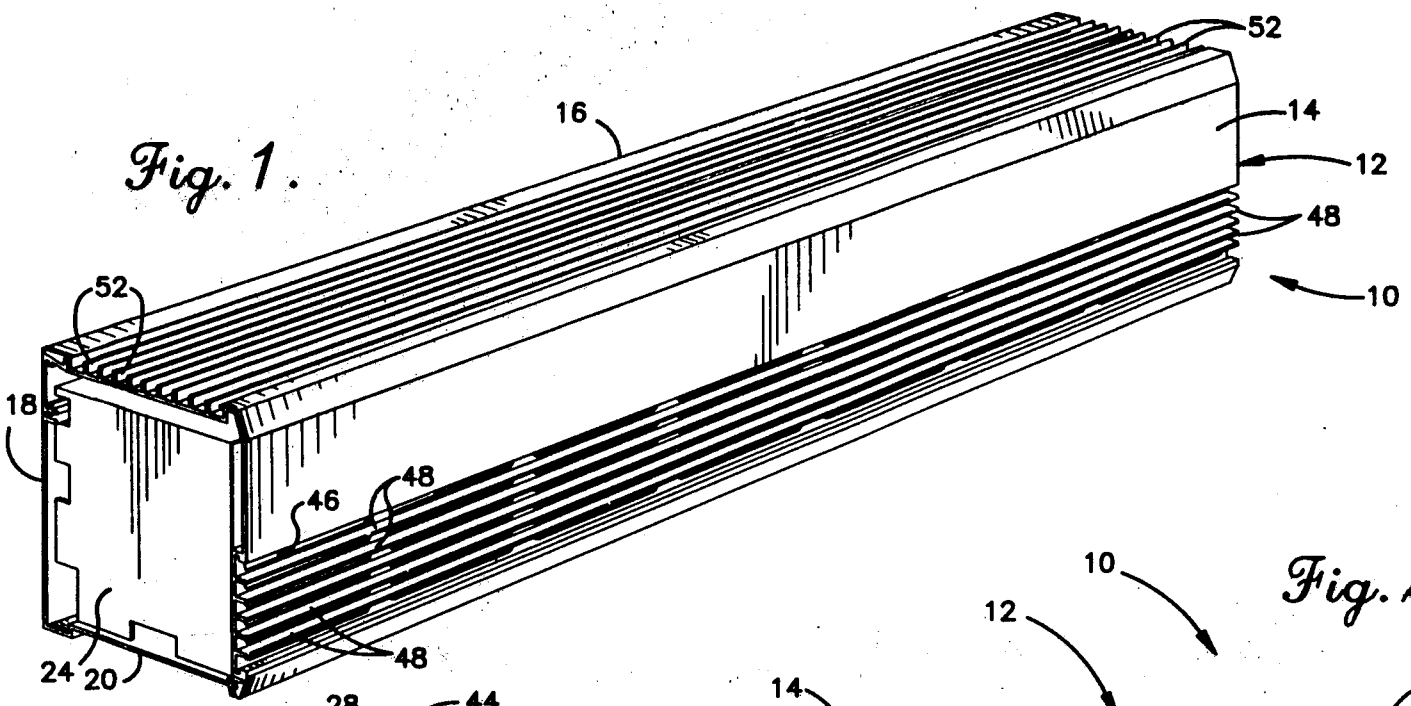
FIG. 1 is a perspective view of a convection heater constructed according to a preferred embodiment of the present invention.
Figure 4:
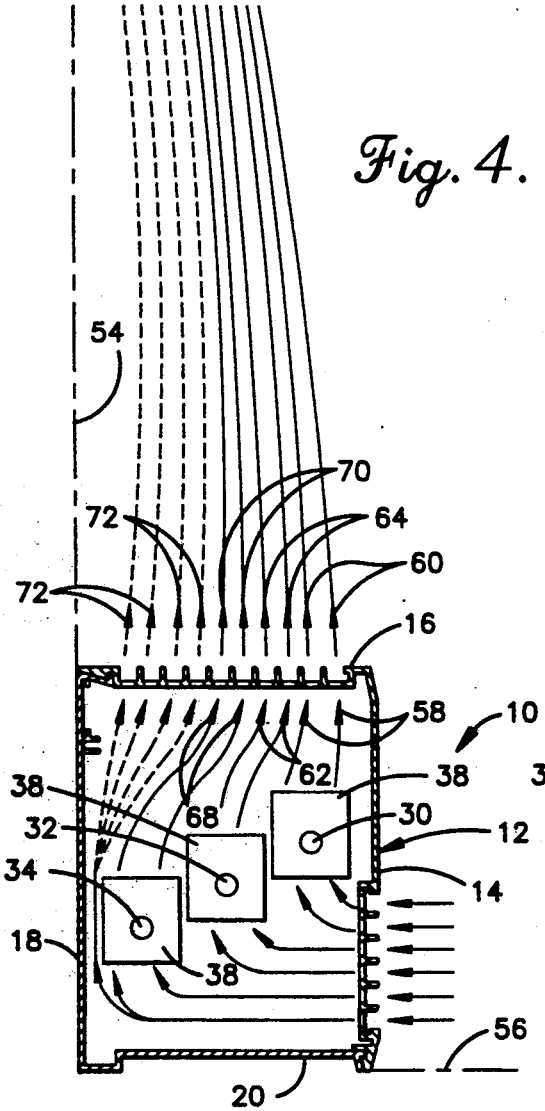
FIG. 4 is a sectional view taken through the housing of the heater on a vertical plane and showing the air flow pattern effected by the heater.

Referring now to the drawings in more detail, numeral 10 generally designates a convection h eater which is used for space heating purposes. The heater 10 has a rectangular housing which is generally identified by numeral 12. As best shown in FIGS. 1 and 4, the housing 12 includes two L shaped sections, one of which presents a front panel 14 and a top panel 16 and the other of which presents a back panel 18 and a bottom panel 20. The edges of the L shaped sections are interconnected by sliding them together to provide the housing 12 with a rectangular configuration. Secured to the opposite end portions of the housing 12 are a pair of inverted U shaped members 22 (see FIG. 2). The U shaped members 22 provide end panels 24 located on opposite ends of the housing 12. Panels 24 are connected with respective interior panels 26 by top connection panels 28. The U shaped members 22 may be screwed or otherwise secured to the housing 12. The panels of the housing 12 may be constructed of sheet metal or any other suitable material.

Mounted within the housing 12 are three elongated electrical heating elements 30, 32 and 34. The elements 30 extend transversely of the heater between the panels 26 and are each arranged in a horizontal orientation spaced from and parallel to the other elements. The ends of the heating elements are supported on sleeves 36 which are suitably mounted to the panels 26. Each heating element is a conventional electrically resistive heating element having a plurality of fins 38 projecting from it for enhanced heat transfer to the air which passes through the housing 12.

In accordance with the present invention, the heating elements 30, 32 and 34 are mounted in a unique stair step configuration which provides the heater with operational advantages. As best shown in FIG. 4, the heating elements 30, 32 and 34 are spaced apart from one another from front to back. Element 30 is the front element of the three and is mounted at a higher elevation than the middle heating element 32. The middle element 32 is in turn mounted at a higher elevation than the rear element 34. It is thus evident that the elements are mounted at progressively lower locations from front to back. Preferably, the spacing between elements 30 and 32 is the same as that between elements 32 and 34, and element 30 is located above element 32 by the same distance as element 32 is located above element 34. The lower element 34 is located well above the bottom panel 20, while the upper element 30 is located well below the top panel 16.

Figure 2:
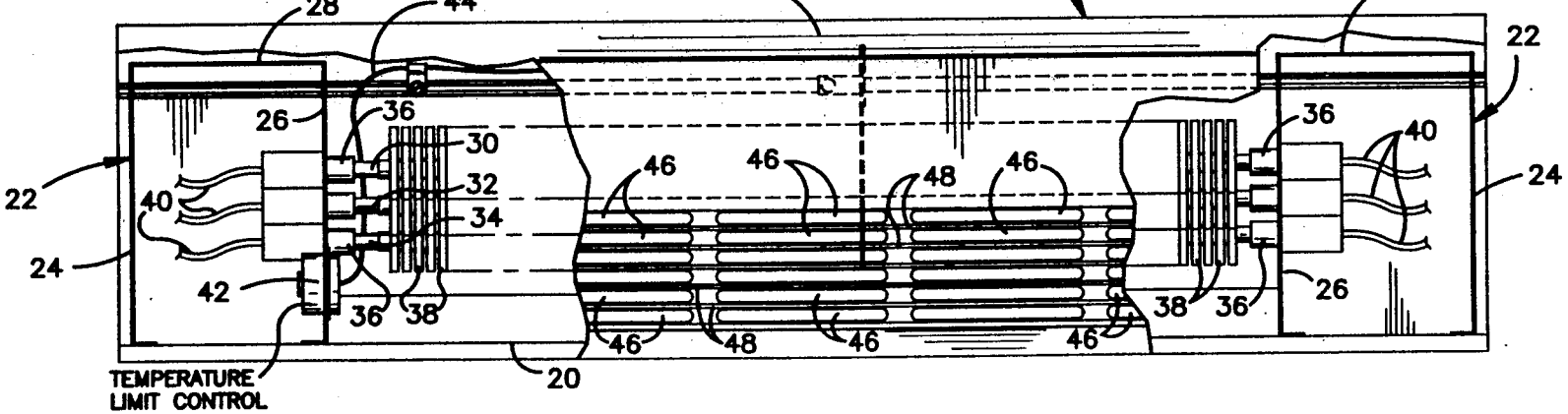
FIG. 2 is a front elevational view of the heater shown in FIG. 1, with portions of the front panel broken away for purposes of illustration.
Figure 3:
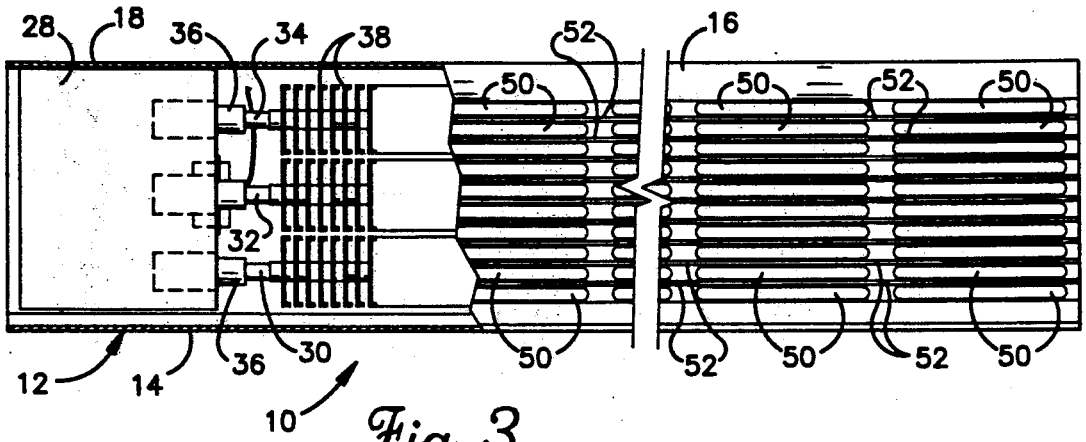
FIG. 3 is a top plan view of the heater shown in FIG. 1, with portions broken away for purposes of illustration and the break lines indicating continuous length.

The heating elements are energized by electrical current which is applied to them by conventional electrical wiring 40 (see FIG. 2). AC power is applied to the wiring 40 through a suitable connection (not shown) to field wiring. The current path for the heating elements preferably includes a heat sensitive limit 42 which interrupts the power to the elements if the temperature rises beyond a safe level. A ground wire 44 may be provided for electrical grounding of the housing 12.

The housing 12 has a plurality of inlets which take the form of inlet slots 46 formed in the lower half of the front panel 14. The slots 46 occupy substantially the entire length of the front panel of the housing and are located between horizontal louvers 48 which extend the entire length of the front panel of the housing.

The top panel 16 is provided with a plurality of outlet slots 50 through which heated air is discharged from the heating unit. The slots 50 extend substantially the entire length of the top panel and are located between louvers 52 which project upwardly from the top panel of the housing.

The heater 10 is installed against a wall such as the wall identified by numeral 54 in FIG. 4. The housing 12 can rest on the floor 56 with the back panel 18 in flat contact with the lower part of the wall 54. Alternatively, the housing can be secured to the wall at an elevated position above the floor. The inlets can be formed in the bottom of the housing on a wall mounted unit.

In operation of the heater 10, the heating elements 30, 32 and 34 are energized with electricity in order to heat the air in the room. The air which is heated by the energized elements rises naturally by convection and passes out of the housing 12 through the outlet slots 50. The air which passes out of the housing 12 induces ambient air to enter the housing through the inlet slots 46, and the air which is drawn into the housing is heated by the elements and discharged through the outlet slots 50.

The staggered or stair step arrangement of the heating elements provides an improved air flow pattern which is best illustrated in FIG. 4. The forward element 30 is also the highest element, and the air which it heats rises above element 30 within the housing 12, as indicated by the directional arrows 58. This air then passes out through the outer or forward slots 50 and rises in the room, as indicated by the directional arrows 60. Because the center element 32 is at a lower elevation then element 30, the air which is heated by element 32 (indicated by the directional arrows 62) is drawn forwardly somewhat by the air rising above the higher element 30. The air heated by element 32 thus rises and flows forwardly as it passes out through the slots 50 which are outboard of the center of the housing, as indicated by the directional arrows 64.

Element 34 is the lowest element, and its elevation below both of the other elements 30 and 32 causes the air which it heats to follow the air rising above the other elements. Consequently, the air which is heated by element 34 rises and flows forwardly somewhat, as indicated by the directional arrows 68. This air passes out of the housing through the slots 50 located near the center of the housing as indicated by the directional arrows 70.

The stair step arrangement of the elements causes the air which is heated by the elements closest to the wall to flow forwardly or away from the wall as it rises, and the hot air which discharges from the heater is located far enough away from the wall to avoid damaging the wall covering. In addition, the element closest to the wall is located at the lowest elevation, and by the time the air heated by it passes out of the housing 12, it has traveled a greater distance than the air heated by the other elements. As a consequence, the air heated by element 34 has had a chance to cool down somewhat before it discharges from the heater.

The flow path indicated by the broken lines and the directional arrows 72 represents air that flows adjacent to the back panel 18 and is thus primarily heated only by the lower element 34. This air is heated only by one of the elements and has a relatively long flow path before it discharges from the heater through the slots closest to the wall 54. As a result, this air is warm but is not as hot as the air which discharges from the heater at location farther from the wall. Consequently, the warm air represented by the directional arrows 72 provides a shield to prevent the hotter air from possibly damaging or streaking the covering for the wall 54.

Figure 5:
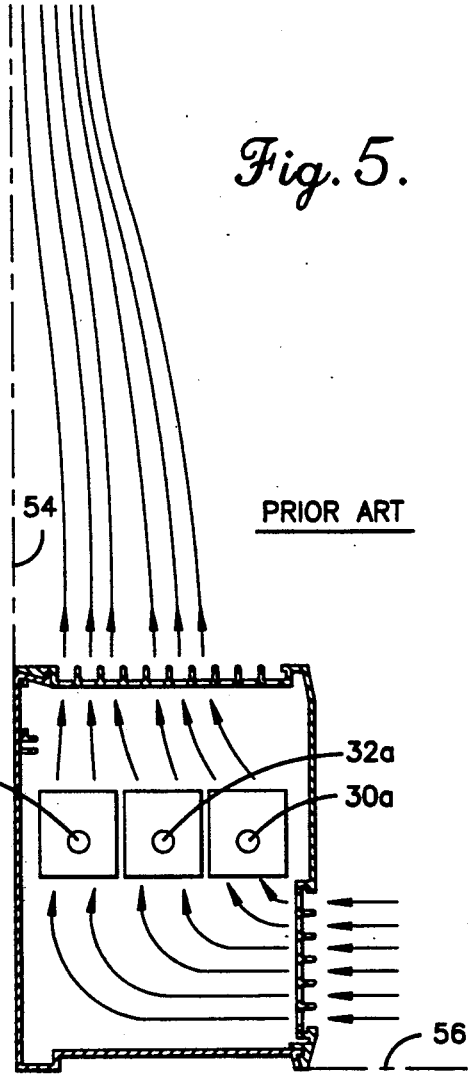
FIG. 5 is a sectional view similar to FIG. 4 showing a typical prior art heater and the air flow pattern effected by it.

FIG. 5 depicts a typical prior art heater. The principal difference in the prior art heater is that its three heating elements 30*a*, 32*a* and 34*a* are all located at the same elevation rather than being arranged in the stair step configuration of the elements in the heater of the present invention.

Because the heating elements in the prior art heater are at the same elevation, the hot air which rises above each of them has little effect on the flow pattern of the air rising above the other elements. Consequently, the air which is heated by each element tends to rise generally above the element and is drawn somewhat toward the wall 54 as a result of the natural tendency for the air to "hug" the lower temperature wall. This effect is more pronounced when heaters are located against the cold walls that comprise the exterior of the building. The air flow pattern is indicated by the flow lines and directional arrows, and it is noted that the hot air is located much closer to the wall 54 than in the case of the heater of the present invention. Additionally, there is no warm air "shield" which serves to protect the wall covering.

It is thus evident that the stair step arrangement of the heating elements in accordance with the present invention effectively counters the wall hugging phenomenon that has created problems in the past, especially streaking and other damage to walls and wall coverings. In addition to causing the hottest air to be farthest away from the wall when it discharges from the housing 12, the stair step heating element configuration creates a more outward flow of the hot air, keeps the hot air away from close proximity to the wall until it has risen a significant distance (and thus cooled off somewhat), and provides a warm air "shield" which protects the wall against the hottest air.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A convection heating unit comprising:

a housing having front and back portions and a top portion presenting a plurality of outlets for discharging heated air from the housing, said housing having air inlet means for admitting ambient air to the housing at a location below the outlets;

a plurality of heating elements spaced apart in the housing between said front and back portions, said elements including a front element near said front portion and a rear element near said back portion and said elements being arranged with each element located at a higher elevation than the element immediately behind it to provide a stair step configuration of the elements;

means for energizing said heating elements to draw air into the housing through said inlet means by convection, heat the air in the housing and discharge the heated air through said outlets; and said outlets occupying a front to back dimension on said top portion which exceeds the distance between the front and back elements and said outlets being located directly above each of said elements, whereby the air rising above the front element induces the air heated by the rear element in a direction toward the front portion of the housing prior to discharge through the outlets.

2. A convention space heater comprising:

an elongated housing having opposite ends, a front, and a back for placement adjacent to a wall in the space to be heated;

a top portion of said housing presenting a plurality of outlets for discharging heated air from the housing;

air inlet means in the housing for admitting ambient air thereto at a location below said top portion of the housing;

a plurality of elongated heating elements extending longitudinally in said housing and oriented generally horizontally, said elements including a front element near said front and a rear element near said back and said elements being spaced apart from said front to said back with each element at a higher elevation than the element immediately behind it; and means for energizing each heat element, said outlets occupying a front to back dimension on said top portion which exceeds the distance between the front and back elements and said outlets being located directly above each of said elements, whereby the air rising above the front element induces the air heated by the rear element in a direction toward the front portion of the housing prior to discharge through the outlets.

3. An electric convection space heater for placement adjacent to a wall, said heater comprising:

a housing having opposite ends and front and back panels, said back panel being adapted for placement adjacent to the wall;

a top portion of said housing presenting a plurality of outlets for discharging heated air therethrough;

air inlet means for admitting ambient air to the housing at a location below said outlets;

a plurality of electric heating elements including a front element near the front panel and a rear element near said back panel arranged to extend longitudinally in the housing with each element having a generally horizontal orientation, said heating elements being spaced apart in the housing from said front panel to said back panel and being located at progressively lower elevations from front to back to provide a stair step configuration in which the heated air rising above each element induces the air rising above the immediately rearward element to flow forwardly away from the wall; and means for energizing said heating elements, said outlets occupying a front to back dimension on said top portion which exceeds the distance between the front and back elements and said outlets being located directly above each of said elements, whereby the air rising above the front element induces the air heated by the rear element in a direction toward the front portion of the housing prior to discharge through the outlets.

* * * * *